United States Patent [19]

Zuffellato

[11] 4,292,750

[45] Oct. 6, 1981

[54] WRITING INSTRUMENT WITH HOLDER OR GRIP PORTION INCORPORATING A PARTIALLY VISIBLE MOVABLE RIBBON

[76] Inventor: Giuseppe Zuffellato, Via Colombo no 90, Grugliasco, Torino, Italy

[21] Appl. No.: 109,454

[22] Filed: Jan. 3, 1980

[30] Foreign Application Priority Data

Jan. 17, 1979 [IT] Italy ..... 67094 A/79

[51] Int. Cl.[3] ..... B43K 29/12; B43K 29/14

[52] U.S. Cl. ..... 40/334; 40/335; 242/67.4; 401/195

[58] Field of Search ..... 401/52, 195; 40/334, 40/335, 905; 242/67.4

[56] References Cited

U.S. PATENT DOCUMENTS

| | | | |
|---|---|---|---|
| 1,925,844 | 9/1933 | Moll | 40/335 |
| 1,993,514 | 3/1935 | Kahn | 40/335 |
| 2,012,437 | 8/1935 | Segal | 242/67.4 |
| 2,191,662 | 2/1940 | Huffaker | 40/334 |
| 2,764,827 | 10/1956 | Custin | 40/335 |

*Primary Examiner*—Steven A. Bratlie
*Attorney, Agent, or Firm*—Young & Thompson

[57] ABSTRACT

A writing pen with writing point of any type, in the holder or grip portion of which is incorporated a movable-ribbon ready reference device readable through a window. This device, pre-printed and capable of being written on by hand, is wound on a pair of spools which can be turned in both directions by means of a knob at the top end of the pen. The knob forms a single whole with a tubular body on the inner surface of which is formed a helical toothing engaged with two toothed pinion gears, each of which is keyed idly to a flexible shaft rotating solidly with one of the spools on which the ribbon-type ready reference device is wound. Forming a pair with each helical tooth pinion gear there is mounted, in an inverted position with respect to the other pair, a second butt pinion gear which is solid with the respective transmission shaft. Each helical tooth pinion gear is free to travel a short longitudinal distance on its own shaft and then to engage or disengage the second butt gear pinion, with the result that each rotation direction of the knob will be matched by an axial translation of the idle pinion gears and the locking of one of them, with the freeing of the other, in the butt pinion gear solid with the transmission shaft, with consequent moving of the ribbon in the same direction

5 Claims, 12 Drawing Figures

WRITING INSTRUMENT WITH HOLDER OR GRIP PORTION INCORPORATING A PARTIALLY VISIBLE MOVABLE RIBBON

The present invention relates to a writing instrument (stylographic, or ballpoint, or fibre- or felt-tip pen, or a mechanical pencil) the holder or grip portion of which comprises a ribbon-shaped roll wound on a pair of spools which can be turned by means of a small knob; the said ribbon appears on a reading window and is adapted to the recording of notes for frequent reference or to being pre-printed with data of various kinds, such as calendars, lists, addresses and the like. More particularly, the invention relates to a writing instrument with holder or grip portion incorporating a partially visible movable ribbon, characterized by the fact that the ribbon is wound on a pair of parallel spools which are alternately solid with a knob at the top of the pen, each spool being made thus solid by the interposing of gear transmission means for transmitting the rotational movement to one spool or the other depending on the direction in which said knob is turned.

Pens, or more properly writing instruments in general, are objects with a history which has accompanied the history of human civilization and to a certain extent may also have influenced and symbolized it. As produced in modern times, these objects mirror a creative endeavour which on occasion transcends their specific function as a result of commercial conditioning of the most variegated kind. The evolution of the pen does not in effect simply serve the requirements of their end-use, but also ancillary aspects, for example decorative aspects, advertising aspects, and others again that can be assigned to an object of this kind. Inasmuch as it is an object of frequent use and thus a personal instrument, the pen has to be considered a vehicle for messages as well as a means permitting the formation of messages. For many types of pen exist which are morphologically adapted to suit advertising requirements and which are then distributed for publicity purposes.

Such adaptations tend above all to allow as much space as possible on the object for the reproduction of the graphic message, whether for advertising purposes or not. In some cases this end has been in a relative degree achieved by providing in the construction of the pen for movable surfaces, such as rotatable or telescopically movable cylinders on which data could be printed for reading through special windows.

Along these lines the present invention intends to provide a graphic visualization device forming the holder or grip portion of a writing instrument of any type, and its originality lies in an exceptional capacity for accommodating data as well as in a functional and novel mechanical concept. The present invention therefore provides a form of rationally available vade mecum in the guise of a ribbon of remarkable length able to carry data spread over several hundreds of lines of writing and thus to carry, for example, a complete calendar or an entire technical formulary or a sequence of informative data. The ribbon is wound on spools rotatable in both directions so as to permit the ready visualization, through a window, of the part printed with the data to which it is wished to refer. Provision is also made for the possible marketing of the pen in question without pre-printing of the ribbon, which thus becomes available for the manual transcription, even with the writing point of the same pen (which in such case will have to be separable from the holder or grip portion), of the data personally required by the user, such as addresses, telephone numbers, etc.

The nature and type of the writing point, moreover, are variable elements of the system and of the form in which the object is embodied, which as regards inventive concept is characterized only by the data storage device, even when this is an indivisible part of the pen itself. The characteristics of the invention are in any case shown in the attached drawings, which illustrate an example of a preferred embodiment thereof, which is not limiting as regards its secondary particulars.

In the said drawings, which are referred to in the detailed description that follows, FIG. 1 is a perspective view of the complete pen with protective cap placed over the writing point;

Figure 12:
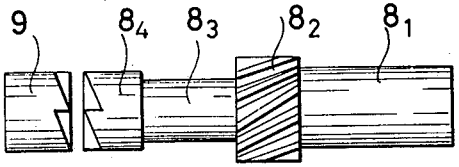
Figure 6:
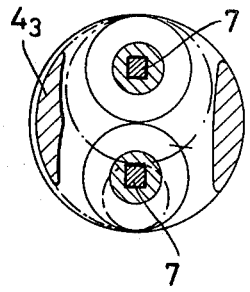

FIGS. 6, 7, 8, 9, 10, and 11 are, respectively, the sections according to the planes B—B; C—C; D—D; F—E; F—F; G—G indicated in FIG. 4;

FIG. 12 is an exploded view of a single pair of the gears destined for transmission of the rotational movement to the spools on which the ribbon-type roll is wound.

The holder or grip portion of the pen as illustrated consists of two parts (the writing element and the visualizer device) combined in a single cylindrical outer casing (1).

Figure 5:
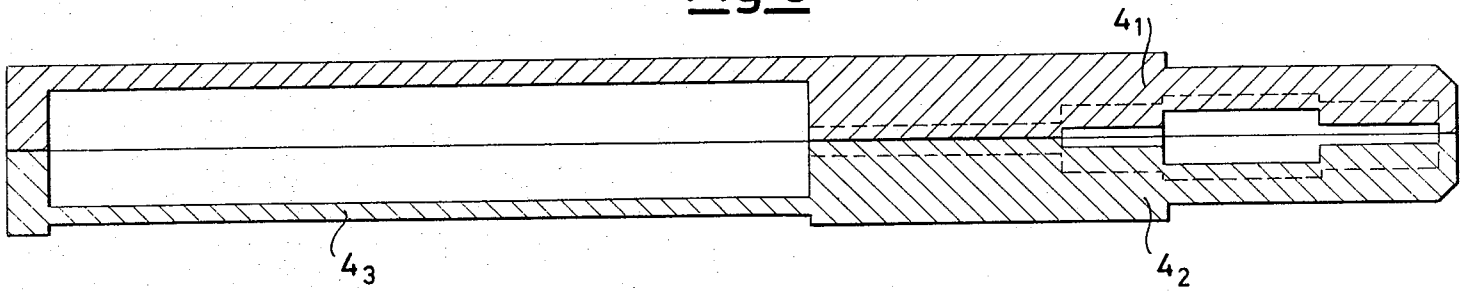
FIG. 5 is a view according to the section A—A of FIG. 4 of the dual-shell body which contains the housings for all the movable parts of the visualizer device.

As previously specified, the said parts can however be made separable by unscrewing, pulling out or other similar systems. The writing element (2), here represented by a ballpoint refill (3), can without distinction be a stylographic pen element, a felt- or fibre-tip element or a mechanical pencil lead, etc., and therefore no description is given of it inasmuch as it is not essential to the invention. The remaining part of the writing instrument constitutes the element in respect of which originality is claimed. The various components of the instrument are contained in a cylindrical body (4) which, in the preferred variant of embodiment, can be divided into two symmetrical shells ($4_1$ and $4_2$) along a diametral plane (see FIG. 5); in its interior are formed the cavities for housing the spools (5) on which the ribbon is wound and the other small mechanical parts by means of which the said spools can be turned.

The spools (5) consist of small cylinders traversed longitudinally by a polygonal section hole (since, however, the drawings show said hole with square section, the description of the particulars pertinent to it will conform to this embodiment thereof). Into the hole of each spool is inserted a shaft (7) made of flexible material having design section the same as that of the hole (square) of the spool into which it is inserted with minimum clearance. The function of said shafts (7) is to transmit to the spools the rotation in the direction determined by the position of the gears, which are also keyed onto them. There are a total of four gear elements keyed onto the shafts, in two twinned pairs. The form shared by two of these elements (8) (shown in FIG. 12) is provided by a cylindrical body which combines solidly four sections of different diameter, and more exactly: a smooth surface segment ($8_1$), a pinion gear with helical teeth ($8_2$), a groove ($8_3$) and a second pinion gear ($8_4$) forming a butt gear.

The form of the other two gear elements (9), on the other hand, is that of a simple small cylinder with butt gearing, to be mated with analogous toothing on the head of the part identified by the numeral 8. These small cylinders are engaged with the shafts by a square axial hole, and rotate solidly with the shafts. Each pair of gears (8 and 9) is fitted over a shaft, but in a reversed position with respect to the pair next to it. The helical toothed pinion gears ($8_2$) of the parts 8 emerge from two slots in the body of the dual-shell container 4 and engage the helical toothing inside a cylindrical cap (10) fitted onto the top end of the writing instrument. The said cap terminates in a knurled knob ($10_1$), operated by hand. The entire system that has been described is retained and held firm by the tubular casing (1) which is the outside portion of the writing instrument.

This casing features a window ($1_1$) through which is visible the section of ribbon 6 held between the two spools and spanning a bridge section ($4_3$) formed in the shell $4_2$ of the cylindrical body 4. A consideration of the drawings and of the foregoing description will show that the visualizer device operates as follows: by turning the knob $10_1$ in one direction (for example clockwise, facing the knob), both the toothed pinion gears $8_2$ (idle on the shafts) are caused to rotate, but, by effect of the inclination of the gear teeth (helical) a thrust component is developed in the direction of the writing point and, as a result of this, the said gears travel the free distance available to them along the shafts over which they are fitted. In this way the gear element $8_4$, shown higher in the drawings, engages the pinion gear 9 facing it, while the lower gear element disengages its respective pinion gear (position illustrated in the drawings). Since the pinion gears 9 rotate solidly with the shafts to which they are keyed, the shaft shown at the top will be drawn into rotation and will transmit the clockwise motion to the relative spool and thus to the ribbon 6, which will move in one direction. If the knob $10_1$ is turned in an anticlockwise direction, the positions of the gears will be reversed and the direction of motion of the ribbon will clearly also be reversed.

Figure 1:
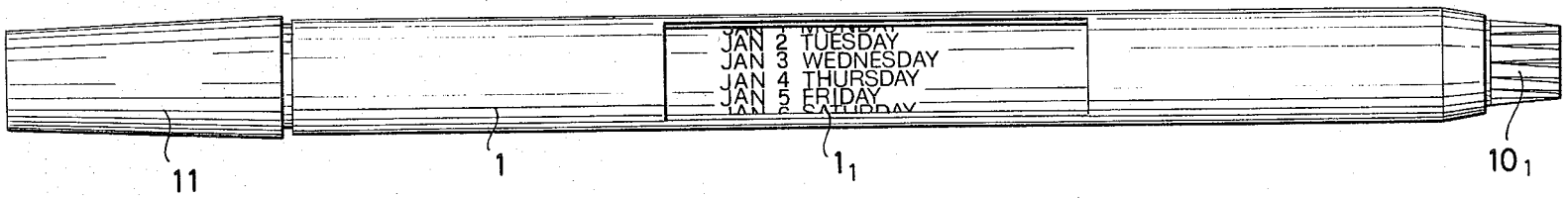
Figure 2:
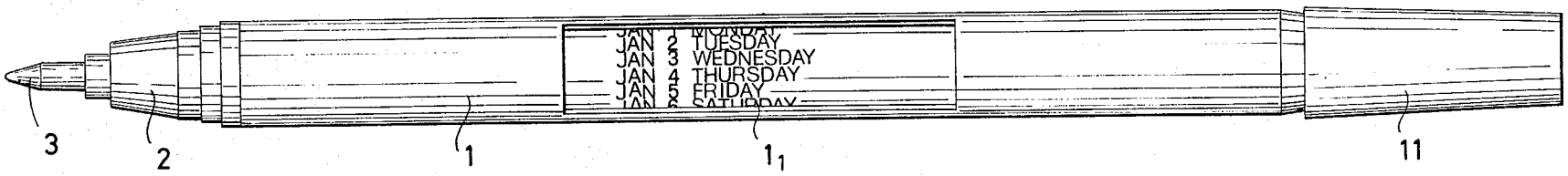
FIG. 2 is a view of the complete pen ready for writing.
Figure 3:
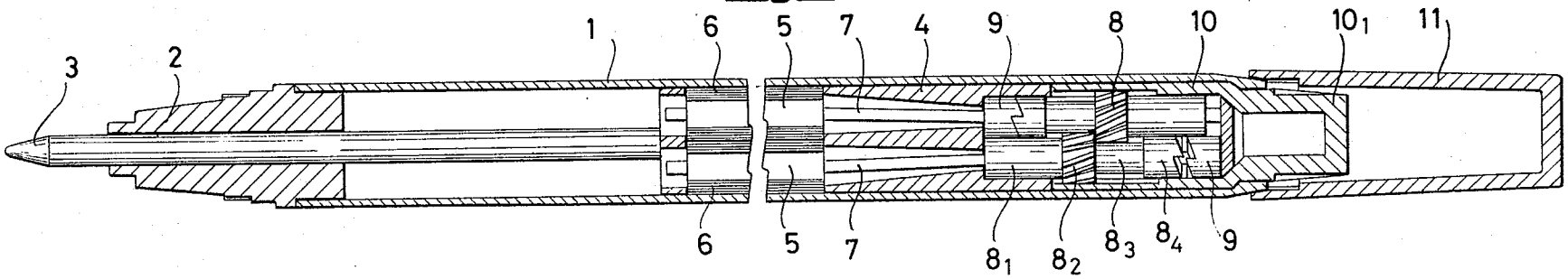
FIG. 3 is a longitudinal median section of the pen in the condition according to FIG. 2.
Figure 4:
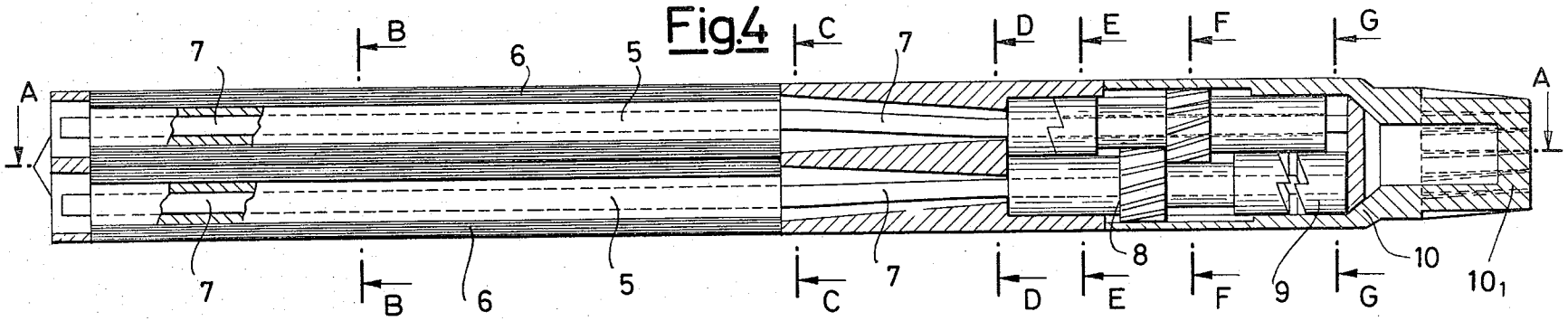
FIG. 4 is a longitudinal median section of the visualizer device only.
Figure 7:
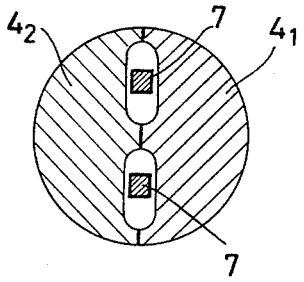
Figure 8:
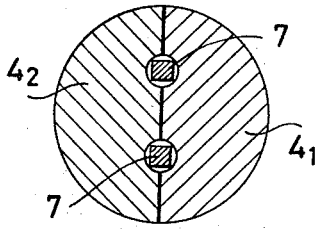
Figure 9:
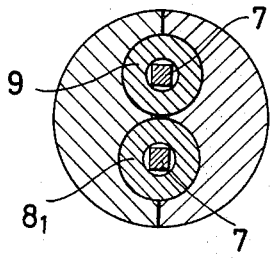
Figure 10:
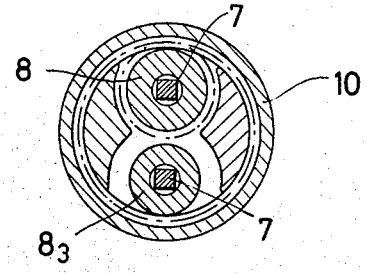
Figure 11:
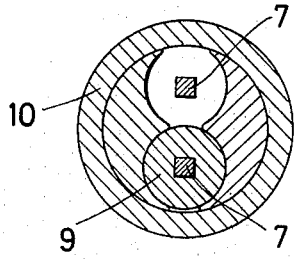

It should be noted that, when the ribbon winds up on one spool and unwinds from the other, the spools gradually vary in diameter to an inversely proportional extent and thus their axes are displaced in parallel translation; for this reason, the transmission shafts have to be made of flexible material and room for oscillation must be provided in their housings (this is shown in FIG. 7, section C—C of FIG. 4). In the expected and preferred form of embodiment, the writing instrument can be accompanied by a cap (11) for protection of the writing point; when this cap is placed over the knurling of the knob $10_1$, with the pen ready for writing, it can be manipulated as an extension of the knob itself.

The data storage capacity of the ribbon-type roll depends on the material of which it is made. Clearly, the thinner the ribbon the greater will be the number of windings on the same spool diameter, and thus its data storage capacity will also be greater. Certain synthetic materials today marketed as very low-thickness film are suitable for the purpose, since they can be printed and are highly resistant to wear and tear.

I claim:

1. A writing instrument comprising a hollow body having a writing point at one end, a knob at the other end rotatable relative to the hollow body, a pair of flexible shafts extending lengthwise of the hollow body in side-by-side relationship, a flexible sheet wound on the shafts in such a way that turning one shaft in one direction winds up the sheet on said one shaft and unwinds the sheet from the other shaft, and turning the other shaft in the opposite direction winds up the sheet on the other shaft and unwinds it from the one shaft, and means interconnecting said knob and said shafts whereby turning said knob in one direction turns said one shaft in said one direction and turning said knob in the opposite turns said other shaft in said opposite direction, the ends of said flexible shafts opposite said knob being free to move in a direction perpendicular to the length of said shafts thereby to permit the rolls of sheet to shift laterally as they change in size during rolling and unrolling.

2. A writing instrument comprising a hollow body having a writing point at one end, a hollow knob at the other end rotatable relative to the hollow body, a pair of shafts extending lengthwise of the hollow body in side-by-side relationship, a flexible sheet wound on the shafts in such a way that turning one shaft in one direction winds up the sheet on said one shaft and unwinds the sheet from the other shaft, and turning the other shaft in the opposite direction winds up the sheet on the other shaft and unwinds it from the one shaft, said hollow knob having internal helical gear teeth thereon, a helical pinion gear keyed to each shaft for rotation with the shaft but axially slidable on the shaft, said helical pinion gears being in mesh with said helical gear teeth on the inside of said hollow knob, a butt pinion gear fixed to said one shaft on the same side of the associated said helical pinion gear as said writing point, a butt pinion gear fixed to said other shaft on the side of the associated said helical pinion gear away from said writing point, said helical pinion gears having butt gear teeth thereon engageable each with the associated said butt pinion gear on the same said shaft, said butt pinion gears being spaced apart lengthwise of the writing instrument a distance such that upon rotation of said knob in one direction, said butt gear teeth on one helical pinion gear move axially into engagement with the associated said butt pinion gear to rotate the associated said shaft in one direction, while upon rotation of said knob in the opposite direction, the other helical pinion gear slides axially on its associated shaft until its butt gear teeth engage with the associated butt pinion gear to rotate the other shaft in the opposite direction.

3. A writing instrument as claimed in claim 2, in which said shafts are flexible and are free to move in a direction perpendicular to the length of the writing instrument thereby to permit accommodation to the changing size of the roll of sheet wound up upon each shaft as the shafts rotate.

4. A writing instrument as claimed in claim 2, said helical pinion gears being identical to each other and being slidably mounted on their respective shafts in reversed relation relative to each other.

5. A writing instrument as claimed in claim 4, said butt pinion gears being identical to each other and being secured on their respective shafts in reversed relation to each other.

* * * * *